United States Patent [19]

Real et al.

[11] Patent Number: 4,501,321

[45] Date of Patent: Feb. 26, 1985

[54] AFTER COOLER, CHARGE AIR COOLER AND TURBULATOR ASSEMBLIES AND METHODS OF MAKING THE SAME

[75] Inventors: John D. Real, Jamestown; David J. Twichell, North Harmony; Lauren R. Weed, Jamestown, all of N.Y.

[73] Assignee: Blackstone Corporation, Jamestown, N.Y.

[21] Appl. No.: 440,518

[22] Filed: Nov. 10, 1982

[51] Int. Cl.[3] ..... F28F 3/12

[52] U.S. Cl. ..... 165/153; 138/157; 138/171; 165/166; 165/170

[58] Field of Search ..... 165/152, 153, 166, 167, 165/170; 138/156, 170, 171, 151

[56] References Cited

U.S. PATENT DOCUMENTS

| | | | |
|---|---|---|---|
| 1,701,752 | 4/1921 | Gargiulo | 165/153 |
| 2,214,057 | 9/1940 | Hull | 165/152 |
| 2,231,982 | 2/1941 | Zalkind | 138/156 X |
| 2,247,891 | 7/1941 | Schneible | 138/157 X |
| 2,912,749 | 11/1959 | Bauernfeind et al. | 165/167 X |
| 3,212,572 | 10/1965 | Otto | 165/166 |
| 3,229,760 | 1/1966 | Hurter | 165/152 |
| 3,521,707 | 7/1970 | Brown | 165/152 |
| 3,556,199 | 1/1971 | DeGroote | 165/153 |
| 3,907,032 | 9/1975 | DeGroote et al. | 165/166 |

FOREIGN PATENT DOCUMENTS

| | | | |
|---|---|---|---|
| 124814 | 7/1947 | Australia | 165/153 |
| 1136336 | 5/1957 | France | 138/157 |
| 560089 | 3/1944 | United Kingdom | 138/157 |
| 582245 | 11/1946 | United Kingdom | 165/152 |

*Primary Examiner*—Sheldon J. Richter

*Attorney, Agent, or Firm*—Buell, Ziesenheim, Beck & Alstadt

[57] ABSTRACT

A charge air cooler is provided made up of a plurality of spaced generally parallel turbulators, each said turbulator comprising an outer channel member having a bottom wall and two transverse side edges, an inner channel member having a bottom wall and two transverse side edges, the side edges of the inner channel interfitting closely within the side edges of the outer channel member, an accordian shaped fin assembly between said channels having side edges of a plurality of accordian folds in contact with the bottom wall of both the inner and outer channel members, a transverse heat exchanger fin assembly between adjacent turbulators, frame means surrounding said turbulators and heat exchangers, header means at each end of said turbulators, and flange means around the periphery of each said header means forming therewith one of an inlet and outlet well whereby the turbulator ends may be operatively connected to a source of fluid to be cooled.

6 Claims, 4 Drawing Figures

AFTER COOLER, CHARGE AIR COOLER AND TURBULATOR ASSEMBLIES AND METHODS OF MAKING THE SAME

This invention relates to after coolers and charge air coolers and turbulator assemblies and methods of making the same and particularly to a turbulator assembly which is assembled and brazed in a single operation.

After coolers and charge air coolers are used in large numbers for trucks and other heavy duty internal combustion powered equipment for air to air heat exchange for turbo chargers, high performance turbo-charged vehicles and the like to improve mileage, reduce operating expenses and costs in general. In such coolers it is important to maintain air flow with a minimal change in pressure drop through the after cooler or charge air cooler. It is also important that there be a large reduction in temperature in the hot air passing through the air cooler.

Charge air coolers and after coolers are generally formed by assembling spaced turbulators between spaced heat exchanger fins, all assembled between a pair of headers. The individual turbulator structures have been a serious problem of expense and assembly to the industry generally. In the past they have been assembled by one of two practices, i.e. forming a long tube of flattened elliptical cross section, pushing a fin assembly through the tube from end to end and soldering the two together or forming a flat rectangular tube from a pair of long sheets as top and bottom with bar stock at each end and fins between and soldering the whole together to form a turbulator. Both practices are expensive and fraught with problems.

The present invention provides a turbulator structure and method of making the same which is simple, relatively inexpensive and virtually foolproof. This in turn leads to a simplified, less expensive charge air cooler or after cooler structure.

The turbulator structure of this invention comprises a pair of elongate closely fitting channels, one having side edges adapted to fit frictionally within the side edges of the other to form an elongate rectangular passage, a fin assembly adapted to be sandwiched between the two when interfitted, and a metallurgical bond between the interfitting edges of the channels and the periphery of the fin assembly. Preferably, the fin assembly is in accordian shape. The channels and fin assembly are preferably frictionally assembled and metallurgically bonded in a single bonding operation. When a plurality of turbulators are to be assembled to form a charge air cooler they are frictionally assembled and placed between headers alternately with transverse heat exchanger fins and the whole assembly metallurgically bonded, e.g. brazed, in a single, e.g., bonding operation. The turbulator structure may be made of aluminum, copper or like metals.

In the foregoing general description certain objects, purposes and advantages of this invention have been set out. Other objects, purposes and advantages of this invention will be apparent from the following description and the accompanying drawings in which.

Figure 1:
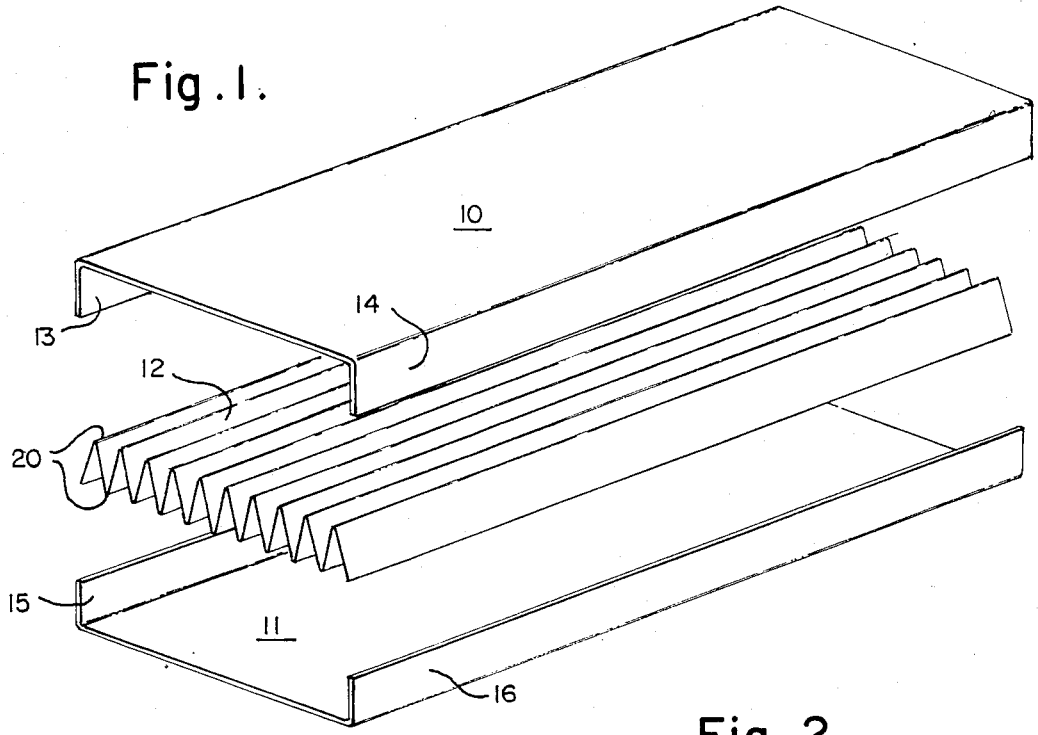
FIG. 1 shows an exploded isometric view of the parts of a turbulator according to this invention.
Figure 2:
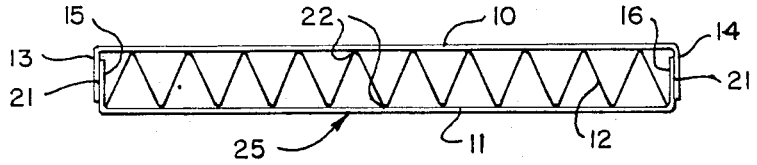
FIG. 2 is an end elevation of a turbulator assembled from the parts of FIG. 1.
Figure 3:
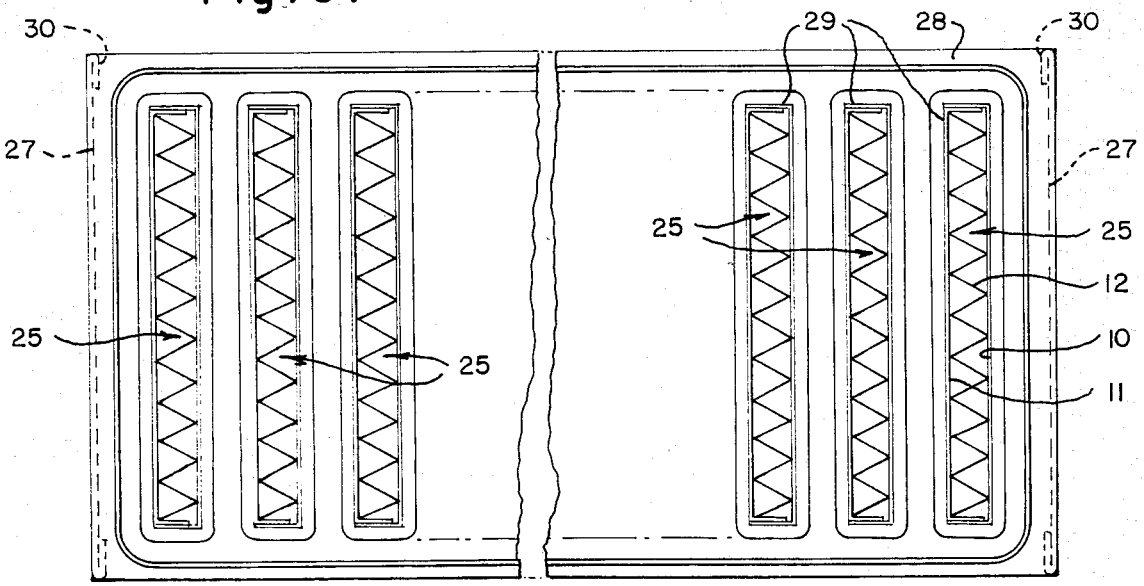
FIG. 3 is a top plan view of a charge air cooler assembly of turbulators, heat exchange fins, headers and side frames according to this invention.
Figure 4:
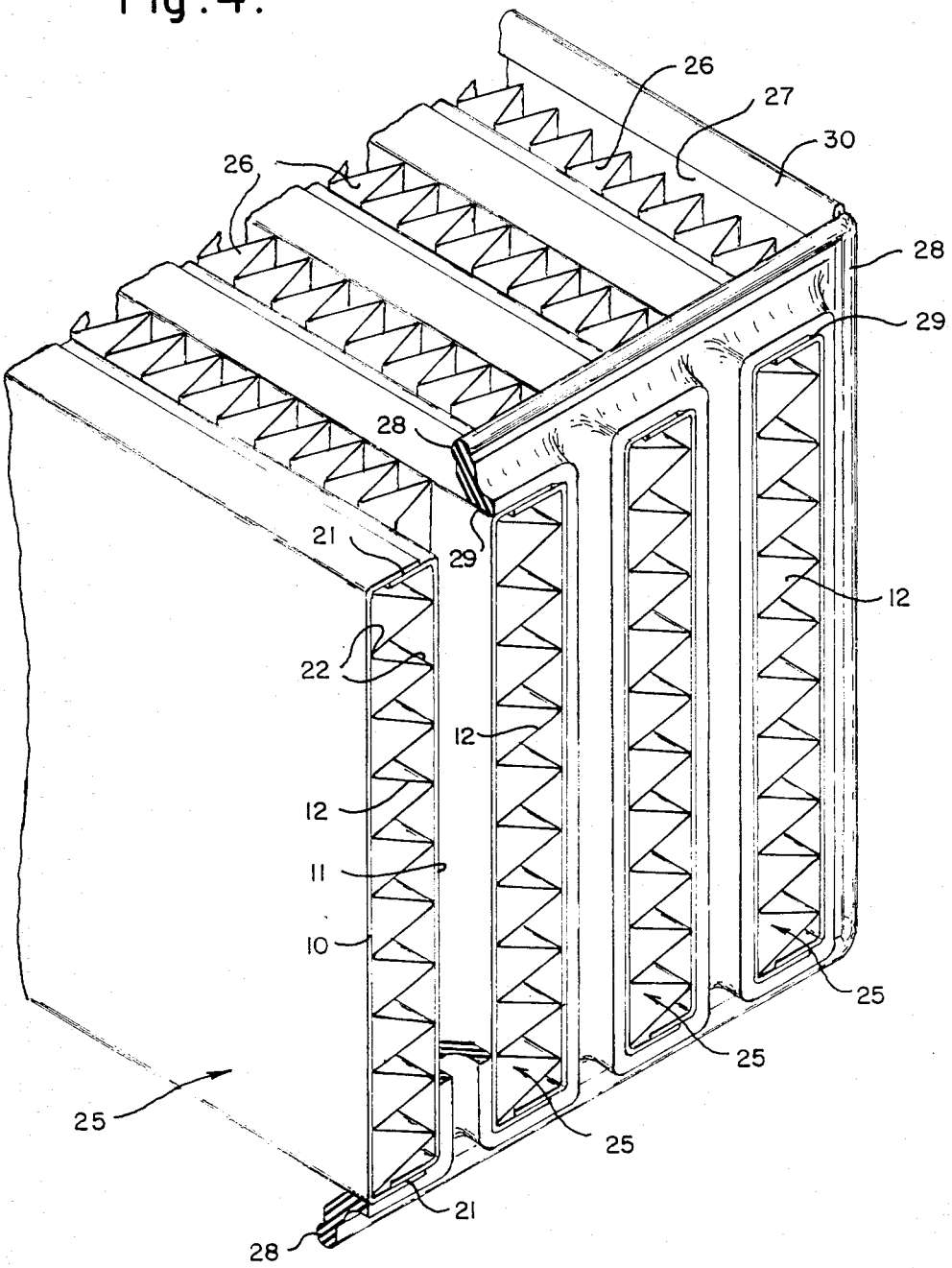
FIG. 4 is a fragmentary isometric view, partly in section of the assembly of FIG. 3.

Referring to the drawings there is illustrated in FIGS. 1 and 2 a single turbulator structure made up of an outer channel member 10 and an inner channel member 11 having sandwiched between them an accordian shaped fin member 12. The fin member 12 could, of course, take other shapes than that of an accordian such as round and square corrugations, truncated triangle and the like. The edges 13, 14 of channel 10 slide over and frictionally engage side edges 15 and 16 of channel 11 with the edges 20 of the fin member 12 in contact with the bottom of each channel. The individual turbulators may be metallurgically bonded together by any known method such as by brazing. The metallurgical bonding results in the formation of a metallurgical bond 21 between edges 13 and 14 and edges 15 and 16 and a metallurgical bond 22 between the top edges of fin member 12 and the bottom of channels 10 and 11.

The structure of this invention provides for expansion of the accordian shaped member 12 during heating for metallurgical bonding by permitting frictionally engaged side edges 13 and 14 of channel 10 to slide over side edges 15 and 16 of channel 11. Prior to metalurgical bonding this same structure permits framing of the assembly to assure fin juncture contact between channels 10 and 11 with the edges of each fin. The result is improved heat transfer because of the improved lineal interface fin juncture contact with the bottom of channels 10 and 11.

An air charge cooler is assembled from a plurality of the turbulators of FIGS. 1 and 2 by assembling a plurality of turbulator assemblies 25 spaced apart with heat exchanger fins 26 and edge frame members 27. This assembly is in turn fitted with a header 28 having openings 29 through which the turbulator assembly ends pass. The sides of the assembly are similarly provided with a peripheral flange 30 forming a part of side or edge frame members 27 which may be connected to a cool air duct (not shown) receiving ambient air from a fan such as the vehicle cooling fan on one side and to discharge air duct on the other.

Preferably, the assembly of turbulators 25, heat exchanger fins 26, edge frame members 27, and peripheral flanges 30 is assembled and brazed in a single operation although brazing may be done by assembly units as the assembly is put together.

In the foregoing specification certain preferred practices and embodiments of this invention have been illustrated and described, however, it will be understood that this invention may be otherwise embodied within the scope of the following claims.

We claim:

1. A turbulator assembly comprising an outer channel member having a bottom wall and two transverse side edges, an inner channel member having a bottom wall and two transverse side edges, the side edges of the inner channel interfitting closely within the side edges of the outer channel member to form a generally rectangular enclosure with adjustable separation, and an accordian shaped fin assembly between said channels having side edges of a plurality of accordian folds which extend above the channel side edges in contact with the bottom wall of both the inner and outer channel members.

2. A turbulator assembly as claimed in claim 1 wherein the side edges of the outer and inner channel members are metallurgically bonded.

3. A turbulator assembly as claimed in claim 1 or 2 wherein the side edges of the accordian folds are metallurgically bonded to the bottom walls of the inner and outer channel members.

4. A charge air cooler comprising a plurality of spaced generally parallel turbulators, each said turbulator comprising an outer channel member having a bottom wall and two transverse side edges, an inner channel member having a bottom wall and two transverse side edges, the side edges of the inner channel interfitting closely within the side edges of the outer channel member to form an adjustable depth generally rectangular enclosure, an accordian shaped fin assembly between said channels having side edges of a plurality of accordian folds which extend above the channel side edges in contact with the bottom wall of both the inner and outer channel members, a transverse heat exchanger fin assembly between adjacent turbulators, frame means surrounding said turbulators and heat exchangers, header means at each end of said turbulators, and flange means around the periphery of each of said header means forming therewith one of an inlet and outlet well whereby the turbulator ends may be operatively connected to a source of fluid to be cooled.

5. A charge air cooler as claimed in claim 4 wherein the parts are metallurgically bonded to form an integral whole.

6. A charge air cooler as claimed in claim 5 wherein the metallurgical bond is by braze metal.

* * * * *

UNITED STATES PATENT AND TRADEMARK OFFICE

CERTIFICATE OF CORRECTION

PATENT NO. : 4,501,321

DATED : February 26, 1985

INVENTOR(S) : JOHN D. REAL; DAVID J. TWICHELL; LAUREN R. WEED

It is certified that error appears in the above-identified patent and that said Letters Patent is hereby corrected as shown below:

Column 2, line 27, change "metalurgical" to --metallurgical--.

Signed and Sealed this

*Seventeenth* Day of *September 1985*

[SEAL]

*Attest:*

DONALD J. QUIGG

*Attesting Officer*

*Commissioner of Patents and Trademarks—Designate*